United States Patent [19]

Colich, Sr.

[11] 4,299,369

[45] Nov. 10, 1981

[54] ADJUSTABLE CURTAIN ROD SUPPORT

[76] Inventor: John M. Colich, Sr., 7412 Calle Cuernavaca Pl., Tucson, Ariz. 85710

[21] Appl. No.: 99,337

[22] Filed: Dec. 3, 1979

[51] Int. Cl.[3] ..... A47M 1/10

[52] U.S. Cl. ..... 248/263; 248/256

[58] Field of Search ..... 248/262, 263, 269, 265, 248/267, 268, 270, 254, 255, 256, 257, 258, 259, 260, 271, 272

[56] References Cited

U.S. PATENT DOCUMENTS

| | | | |
|---|---|---|---|
| 930,818 | 8/1909 | Westhauser | 248/272 |
| 938,088 | 10/1909 | Sullivan | 248/269 |
| 971,988 | 10/1910 | Goppelt | 248/272 |
| 1,013,127 | 11/1912 | Chalko | 248/258 |
| 1,028,164 | 6/1912 | Walker | 248/262 X |
| 1,216,277 | 2/1917 | Brunner | 248/256 |
| 1,444,463 | 2/1923 | Hughes | 248/271 |
| 1,473,291 | 11/1923 | Harsh | 248/271 |
| 2,896,900 | 7/1959 | Fiedler | 248/262 |
| 3,434,685 | 3/1969 | Gorgone | 248/263 |

*Primary Examiner*—J. Franklin Foss

*Attorney, Agent, or Firm*—Cahill, Sutton & Thomas

[57] ABSTRACT

An adjustable curtain rod support includes a horizontal slide plate and two attachment leaves integral with the slide plate for attaching the adjustable curtain rod support to a window frame. One attachment leaf is bent behind and parallel to the slide plate. The other attachment leaf is bent behind the slide plate and is either parallel or perpendicular to the slide plate. A slide assembly is adjustably attached to the slide plate and includes a back plate and a front plate. The back plate and the front plate are disposed on opposite sides of the slide plate. A curtain rod or shade support element is attached to the front plate. A second slide assembly is also adjustably attached to the slide plate for supporting a second curtain rod.

7 Claims, 8 Drawing Figures

ADJUSTABLE CURTAIN ROD SUPPORT

BACKGROUND OF THE INVENTION

1. Field of the Invention

The invention relates to adjustable support devices useful in installing curtain rods, shades or drape rods.

2. Description of the Prior Art

A wide variety of adjustable brackets for supporting curtain rods, window shades, cafe rods, drape rods and the like have been proposed. The state of the art in this area is believed to be well illustrated by U.S. Pat. Nos. 1,444,463; 705,570; 2,998,955; 3,104,806; 3,199,823; 3,198,471; 2,679,373; 1,953,450; and 1,485,117. The various curtain rod support devices and shade support devices disclosed in the above patents suffer from a variety of shortcomings. Some of the brackets are unduly complex, and have a relatively large number of parts; these brackets therefore are unduly expensive to manufacture and unduly difficult to install. Others of the brackets disclosed in the above patents tend to be structurally weak. Several have the disadvantage that portions of the bracket extend further beyond the area covered by the supported curtain than is desirable.

Accordingly, it is an object of the invention to provide an adjustable curtain rod or shade support which is highly rigid.

Another object of the invention is to provide an adjustable curtain rod or shade support which provides a high degree of adjustability and yet is easily adjustable after the device has been attached to a window frame.

Another object of the invention is to provide a durable, inexpensive window shade or curtain rod support having few parts.

There are a variety of window framing schemes utilized in houses of various ages and types in various parts of the United States. In some cases, a wide frame is provided around the top and sides of the window, allowing secure attachment of a wide variety of shade support or curtain rod support devices. In some homes, the walls are plastered to the edges of the window openings and the sides of the window openings are also plastered. It is frequently difficult to obtain adequate anchoring of curtain rod supports for such window openings without using special hollow wall anchoring devices. When such anchoring devices are utilized, ordinarily a large hole needs to be drilled through the plaster or dry wall material; the hollow wall anchors are inserted into the drilled holes. A screw is then tightened to cause expanding of the anchors inside the hollow wall. The screws must then be removed and then utilized to attach the curtain supports. This procedure is time-consuming and tedious.

Accordingly, it is another object of the invention to provide a curtain rod or shade support device which can be easily installed adjacent to window openings which do not have continuous solid wood frames.

The adjustable shade supports shown in U.S. Pat. No. 1,444,463 provides a good degree of adjustability. However, its attachment leaves are hinged to a horizontally slotted cross member. The device is rather awkward to install because of the loosely hinged leaves. Its structure is unduly complex, and the device is unduly expensive. The device shown in U.S. Pat. No. 701,570 provides continuous lateral adjustment, but is not sufficiently durable to support heavy curtains or drapes.

Accordingly, it is another object of the invention to provide an inexpensive yet rigid, adjustable curtain or shade support which is easy to utilize and install.

Another object of the invention is to provide a continuously adjustable, low cost, easily installed curtain rod or shade support which overcomes the various shortcomings of the prior curtain rod or shade support devices and which is capable of supporting more than one curtain rod or shade support.

SUMMARY OF THE INVENTION

Briefly described, and in accordance with one embodiment thereof, the invention provides a shade support for supporting the ends of curtain rods, window shade rollers, cafe rods and the like. The curtain rod support includes, in one of the described embodiments, first and second wall plates integral with a cross member. The cross member includes flat parallel inner and outer surfaces and semicircularly curved end portions connected to the respective edges of the first and second wall plates. The wall plates are spaced from the inner surfaces of the cross member. In one embodiment of the invention, one of the wall plates is perpendicular to the inner and outer surfaces of the cross member and to the other wall plate. An adjustable slide assembly includes a rear plate and a front plate, the rear plate having threaded holes for receiving screws which pass through clearance holes of the front plate. The rod support element is attached to the front plate. Different configurations of rod support elements are utilized to support different types of curtain rods. In one described embodiment of the invention the curved metal strip configured to form a spring clip is utilized to support cafe rods. The various described embodiments of the invention are easily attachable to a variety of window frames. The adjustable slide assemblies are easily installed upon the cross members and are easily positionable to accommodate the various curtain rods and to allow a curtain supported by the curtain rod to completely or nearly completely cover the curtain rod supports. Two or three different adjustable slide assemblies can be adjustably installed on a single cross member to support ends of two or three overlapping curtains, drapes, or shades.

DESCRIPTION OF THE INVENTION

Figure 1:
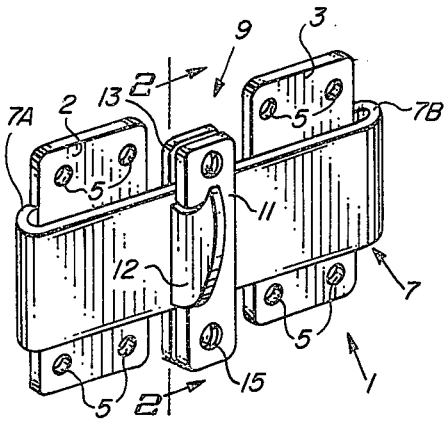
FIG. 1 is a perspective view of one embodiment of the invention.
Figure 2:
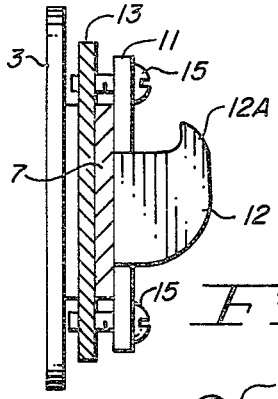
FIG. 2 is a section view taken along section lines 2—2 of FIG. 1

Referring now to FIGS. 1 and 2, adjustable curtain rod mounting device 1 includes first and second wall plates 2 and 3 attached to the opposed curved ends 7A and 7B of cross member 7.

Wall plates 2 and 3 have flat surfaces which are parallel to each other and are parallel to the flat inner and outer surfaces of cross member 7. Curved ends 7A and 7B are semicircular, producing a gap between adjacent surfaces of wall plates 2 and 3 and the inner surface of cross member 7.

Figure 3:
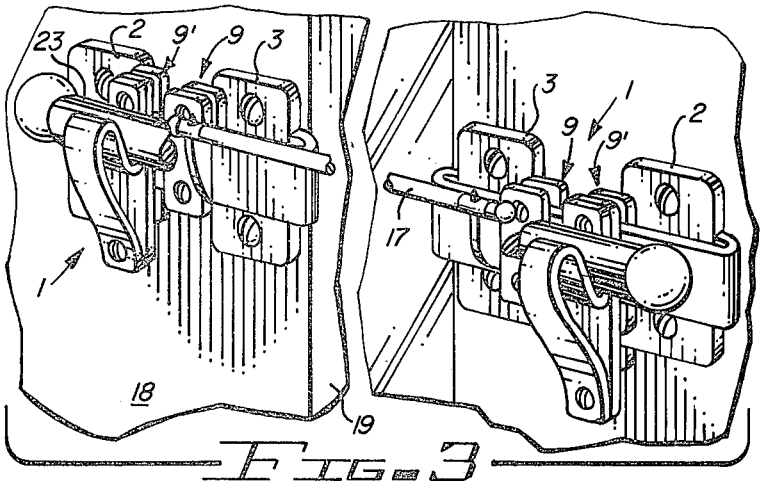
FIG. 3 is a perspective view illustrating an installation of a curtain rod using the device of FIG. 1

Wall plates 2 and 3 each have a plurality of screw holes 5 located above the upper edge of cross member 7 and below the lower edge of cross member 7 to allow convenient attaching of cross member 7 below the lower curtain edge to allow convenient attachment of curtain rod support 1 to wall surface areas adjacent a window, as shown in FIG. 3.

Preferably, wall plates 2 and 3 and cross members 7 are formed of a single piece of aluminum or sheet metal.

Laterally adjustable slide assembly 9 includes a front plate 11, a rear plate 13, a pair of screws 15, and a rod support element 12. As best seen in FIG. 2, back plate 13 is disposed against an inner surface of cross member 7. Front plate 11 is disposed against the outer surface of cross member 7. Back plate 13 and front plate 11 are drawn together to frictionally engage the inner and outer surfaces of cross member 7 by means of screws 15, which extend through clearance holes in front plate 11 and threaded holes in rear plate 13.

Rod support 12 extends from front plate 11, and has a pointed upper protrusion 12A which extends into a receiving hole in a curtain rod and/or end of a window shade roller assembly.

Rod support 12 can be integral with front plate 11 or can be otherwise attached thereto. Front plate 11 and rear plate 13 can be punched out of the same sheet of metal material as the integral unit including wall plates 2 and 3 and cross member 7, and can be formed of the scrap pieces produced by punching of that integral unit from a single piece of metal sheet material.

Figure 7:
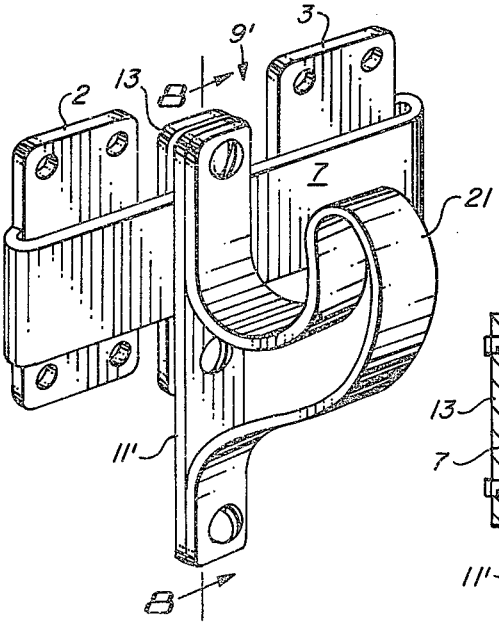
FIG. 7 is a perspective view of another embodiment of the invention.

Referring now to FIG. 3, two of the curtain rod supports 1 are fastened by means of attachment screws extending through screw holes 5 to fasten two of the devices of FIG. 1 to upper opposed corners of wall 18 surrounding a window frame 19. Curtain rod 17 has two small holes perpendicular to the axis of curtain rod 17, through which holes the protrusions 12A of slide assembly 9 extend, thereby supporting the curtain rod. A second slide assembly 9′ is also attached to each of the curtain rod supports 1 to support a cafe rod 23. Slide assembly 9′ is shown in FIG. 7 and is described hereinafter.

In order to install each of the curtain rod supports 1, the unitary element of that curtain rod support, including wall plates 2 and 3, and cross member 7 (but not adjustable support assembly 9) is attached to a wall surface area located adjacent to one of the opposed upper corners of window frame 19. If desired, the inner wall plates 2 and 3 can overlay window frame 19. Ordinarily, there will be solid wooden supports surrounding window frame 19 beneath the wall surface. However, if there is a hollow space behind the wall panel, any of a wide variety of hollow wall fasteners can be installed in the wall surface at locations determined by marking with a pencil through screw holes 5 with the curtain rod support 1 held in the desired mounting position.

Next, the person installing the curtain rod passes the upper screw 15 through the corresponding clearance hole of plate 11 and then screws 15 partly into the threaded upper screw hole of rear plate 13. The person then climbs up on a stool or ladder being utilized and positions the partially assembled slide assembly 9 over cross member 7 and aligns the lower clearance hole of front plate 11 with the lower threaded hole of rear plate 13. He then partially threads lower screw 15 into the lower threaded hole of rear plate 13. He then positions slide assembly 9 approximately to the desired position and tightens screws 15.

After the above operations have been completed for both of the curtain rod supports 1, the installer then positions curtain rod 17 so that its transverse mounting holes receive the upward protrusions 12A of each rod support element 12. If curtain rod 17 is of the telescoping variety, it is easy to position each of the slide support assemblies 9 in desired positions along the corresponding cross member 7, usually at a point as far as possible away from the nearest edge of window frame 19 so that the curtain hung on the curtain rod covers both curtain rod supports. If the length of the curtain rod 17 cannot be adjusted, the two slide support assemblies 9 can be easily laterally positioned along the corresponding cross members 7 to "balance" the position of curtain rod 17 without the window frame 19.

The above described curtain rod support structure and installation method facilitates safe and convenient installation of a curtain rod by relatively unskilled persons.

One hand of the installer is always free so that the palm of the hand can be used to enable the installer to support himself against the wall surface while his other hand is utilized to deploy a screwdriver to attach wall plates 2 and 3 to the wall surface and later to tighten slide assembly screws 15.

Figure 8:
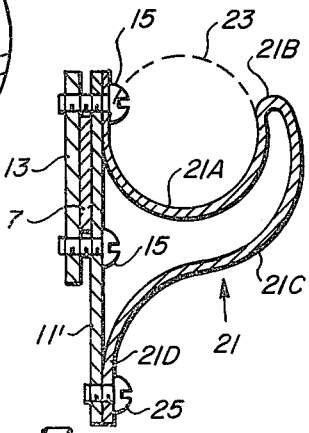
FIG. 8 is a section view taken along section lines 8—8 of FIG. 7.

As later explained, a variety of rod support elements other than rod support element 12 can be utilized, as indicated in FIGS. 7 and 8, to support other types of rods, such as large diameter cafe rods.

Figure 6:
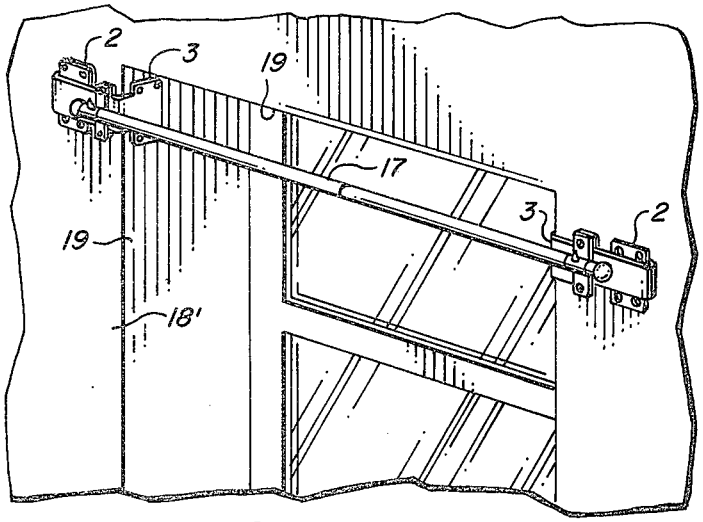
FIG. 6 is a perspective view illustrating an installation of a curtain rod using the device of FIG. 4.
Figure 4:
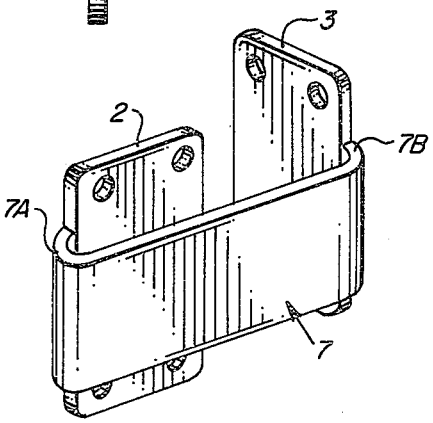
FIG. 4 is a partial perspective view of a modified version of the device of FIG. 1.
Figure 5:
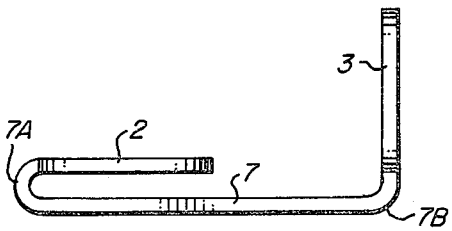
FIG. 5 is a top view of the device of FIG. 4.

Referring now to FIG. 4, an alternate embodiment of the device of FIG. 1 is shown wherein wall plate 3 is perpendicular to cross member 7, instead of being parallel thereto, (as shown in FIG. 1). Otherwise, the embodiment of the invention illustrated in FIGS. 4, 5, and 6, is identical to that shown in FIGS. 1, 2, and 3. The top view of FIG. 5 shows more precisely the relationship of wall plates 2 and 3 to cross member 7. This embodiment of the invention is especially useful for installing curtain rods or shade rollers around a window installed at the upper end of a deep window enclosure, as shown in FIG. 6. In this type of situation, there are usually underlying wood uprights to which screws extending through screw holes of wall plates 2 and 3 can be conveniently anchored, as shown in FIG. 6. This may enable the curtain rod supports 1 to be positioned closer to the edges of the window enclosure opening than if the embodiment of the invention of FIG. 1 is utilized. This may obviate need for using hollow wall fasteners to attach the wall plates 2 located further away from the edge of the window enclosure.

As previously mentioned, if it is desirable to install a large diameter cafe rod, a front plate 11′ which is substantially longer than rear plate 13 can be utilized as shown in FIG. 7. Front plate 11′ has as additional threaded screw hole at its lower end to facilitate attachment thereto of a curved metal strip 21. The upper end of curved metal strip 21 is attached to the upper end of front plate 11′ by means of upper screw 15 (FIG. 2), which is utilized to draw front plate 11′ and rear plate 13 together to frictionally engage cross member 7.

As best seen in the section view of FIG. 8, curved metal strip 21 has a semicircular curved portion 21A which receives a cafe rod (which is indicated by dotted line 23). Curved strip 21 also has a second curved portion 21B having a much smaller radius of curvature than curved portion 21A. Curved strip 21 has another curved portion 21C which extends between curved portion 21C which extends between curved portion 21B and lower end 21D. This configuration causes curved strip 21 to function as a spring clip which engages the cafe rod 23.

Of course, a variety of other support elements can be attached to front plate 11 or 11' to support different types of curtain rods or the like. Further, modifications to the wall plates 2 and 3 can be made to facilitate attachment of curtain rods support 1 to other types of surfaces. For example, in FIG. 6 the upper portions of wall plates 3 can be bent to be perpendicular to the lower portions thereof enabling the curtain rod supports 1 to be installed at the highest height in the window enclosure. The upper screw holes in wall plates 3 are then attached to the upper surface of the window enclosure 19. In certain instances, windows are surrounded by frames which extend outwardly from the surrounding wall surface; the perpendicular wall plates 3 can be fastened to the outer edges of such frames.

While the invention has been described with reference to several particular embodiments thereof, those skilled in the art will be able to make various obvious modifications of the disclosed structures without departing from the true spirit and scope of the present invention.

I claim:

1. A device for supporting curtain rods or shades, said device comprising in combination:

(a) first and second wall plates for attachment to first and second wall surface areas located adjacent to a window;

(b) cross member means having first and second ends rigidly connected to said first and second wall plates, respectively, said cross member means and said first and second wall plate means being composed of a single piece of metal, said cross member means having a flat inner surface and a flat outer surface parallel to the inner surface, wherein said first and second wall plates are parallel to and spaced from said inner surface of said cross member means, said single piece of metal having a first U-shaped fold section connecting said first wall plate to said first end of said cross member means and a second U-shaped fold section connecting said second wall plate to said second end of said cross member section, said first and second wall plates each extending above said cross member means, said first and second wall plates each including a plurality of screw holes located above said cross member means to facilitate attachment of said first and second wall plates to said first and second wall surface areas, respectively, (c) first slide support means slidably disposed on said cross member means for supporting an end of a curtain rod or shade, said first slide support means including i. a back plate having a flat surface disposed against the inner surface of said cross member means, ii. a front plate having a flat surface disposed against the outer surface of said cross member means, iii. connecting means for connecting said front plate to said back plate to force said back plate and said front plate against the inner and outer surfaces of said cross member means, respectively, and iv. a support element attached to said front plate for engaging and supporting the end of the curtain rod or shade, wherein said back plate and said front plate each extend above and below said cross member means, said back plate having first and second threaded holes disposed above and below said cross member means, said front plate having first and second holes aligned, respectively, with said first and second threaded holes, said connecting means including a first screw extending through said first hole and said first threaded hole and a second screw extending through said second hole and said threaded hole, respectively, to allow safe, convenient mounting and adjustable positioning of said first slide support means on said cross member means.

2. The device of claim 1 wherein said support element is integral with said front plate and includes an upwardly extending protrusion for extending through a receiving opening in the end of the curtain rod or shade.

3. The device of claim 1 wherein said support element includes a curved metal strip connected by means of screws to the upper and lower ends of said front plate, a portion of said metal strip being semicircularly curved to engage, support and retain an end of a round cafe rod.

4. The device of claim 1 further including second slide support means similar to said first slide support means for supporting an end of another curtain rod or shade, said second slide support means including a support element for supporting the other curtain rod or shade, said support element of said second slide support means extending further from said cross member means than said support element of said first slide support means.

5. A device for supporting curtain rods or shades, said device comprising in combination:

(a) first and second wall plates for attachment to first and second wall surface areas located adjacent to a window;

(b) cross member means having first and second ends rigidly connected to said first and second wall plates, respectively, said cross member means and said first and second wall plate means being composed of a single piece of metal, said cross member means having a flat inner surface and a flat outer surface parallel to the inner surface, wherein said first and second wall plates are parallel to and spaced from said inner surface of said cross member means, said single piece of metal having a first U-shaped fold section connecting said first wall plate to said first end of said cross member means and a second U-shaped fold section connecting said second wall plate to said second end of said cross member section, and said first and second wall plates each extending above said cross member means, said first and second wall plates each including a plurality of screw holes located above said cross member means to facilitate attachment of said first and second wall plates to said first and second wall surface areas, respectively;

(c) first slide support means slidably disposed on said cross member means for supporting an end of a first curtain rod or shade, said first slide support means including i. back plate means having a flat surface disposed against the inner surface of said cross member means, ii. front plate means having a flat surface disposed against the outer surface of said cross member means, iii. connecting means for connecting said front plate means to said back plate means to force said back plate means and said front plate means against the inner and outer surfaces of said cross member means, respectively, and iv. first support means attached to said front plate means for engaging and supporting said end of said first curtain rod or shade, wherein said back plate means and said front plate means each extend above and below said cross member means, said back plate means having first and second threaded holes disposed above and below said cross member means, said front plate means having first and second holes aligned, respectively, with said first and second threaded holes, said connecting means including a first screw extending through said first hole and said first threaded hole and a second screw extending through said second hole and said second threaded hole, respectively, to allow convenient mounting and adjustable positioning of said first slide support means on said cross member means, and iv. second support means attached to said front plate means for engaging and supporting an end of a second curtain rod or shade.

6. A device for supporting curtain rods or shades, said device comprising in combination:

(a) first and second wall plates for attachment to first and second wall surface areas, located adjacent to a window;

(c) cross member means having first and second ends rigidly connected to said first and second wall plates, respectively, said cross member means and said first and second wall plates being composed of a single piece of metal, said cross member means having a flat inner surface and a flat outer surface parallel to the inner surface, wherein said first and second wall plates are parallel to and spaced from said inner surface of said cross member means, said single piece of metal having a first U-shaped fold section connecting said first wall plate to said first end of said cross member means and a second U-shaped fold section connecting said second wall plate to said second end of said cross member section, said first and second wall plates each extending above said cross member means, said first and second wall plates each including a plurality of screw holes located above said cross member means to facilitate attachment of said first and second wall plates to said first and second wall surface areas, respectively;

(c) first slide support means slidably disposed on said cross member means for supporting an end of a first current rod or shade, said first slide support means including i. a first back plate having a flat surface disposed against the inner surface of said cross member means, ii. a first front plate having a flat surface disposed against the outer surface of said cross member means, iii. first connecting means for connecting said first front plate to said first back plate to force said first back plate and said first front plate against the inner and outer surfaces of said cross member means, respectively, iv. a first support element attached to said front plate for engaging and supporting said end of said first curtain rod or shade, wherein said first back plate and said first front plate each extend above and below said cross member means, said first back plate having first and second threaded holes disposed above and below said cross member means, said first front plate having first and second holes aligned, respectively, with said first and second threaded holes, said first connecting means including a first screw extending through said first hole in said first threaded hole and a second screw extending through said second hole in said second threaded hole, respectively, to allow convenient mounting and adjustable positioning of said first slide support means on said cross member means;

(d) second slide support means slidably disposed on said cross member means for supporting an end of a second curtain rod or shade, said second slide support means including i. a second back plate having a flat surface disposed against the inner surface of said cross member means, ii. a second front plate having a flat surface disposed against the outer surface of said cross member means, iii. second connecting means for connecting said second front plate to said second back plate to force said second back plate and said second front plate against the inner and outer surfaces of said cross member means, respectively, and iv. a second support element attached to said second front plate for engaging and supporting said end of said second curtain rod or shade wherein said second back plate and said second front plate each extend above and below said cross member means, said second back plate having third and fourth threaded holes disposed above and below said cross member means, said second front plate having third and fourth holes aligned, respectively, with said third and fourth threaded holes, said second connecting means including a third screw extending through said third hole and said third threaded hole, a fourth screw extending through said fourth hole and said fourth threaded hole, respectively, to allow convenient mounting and adjustable positioning of said second slide support means on said cross member means.

7. A device for supporting curtain rods or shades, said device comprising in combination:

(a) first and second wall plates for attachment to first and second wall surface areas located adjacent to a window;

(b) cross member means having first and second ends rigidly connected to said first and second wall plates, respectively, said cross member means and said first and second wall plate means being composed of a single piece of metal, said cross member means having a flat inner surface and a flat outer surface parallel to the inner surface, wherein said first wall plate is parallel to and spaced from said inner surface of said cross member means, said second wall plate is perpendicular to said inner surface of said cross member means, said single piece of metal having a U-shaped fold section connecting said first wall plate to said first end of said cross member means and an L-shaped fold section connecting said second wall plate to said second end of said cross member section, said first and second wall plates each extending above said cross member means, said first and second wall plates each including a plurality of screw holes located above said cross member means to facilitate attachment of said first and second wall plates to said first and second wall surface areas, respectively, wherein said first and second wall surface areas being perpendicular, (c) first slide support means slidably disposed on said cross member means for supporting an end of a curtain rod or shade, said first slide support means including i. a back plate having a flat surface disposed against the inner surface of said cross member means, ii. a front plate having a flat surface disposed against the outer surface of said cross member means, iii. connecting means for connecting said front plate to said back plate to force said back plate and said front plate against the inner and outer surfaces of said cross member means, respectively, and iv. a support element attached to said front plate for engaging and supporting the end of the curtain rod or shade, wherein said back plate and said front plate each extend above and below said cross member means, said back plate having first and second threaded holes disposed above and below said cross member means, said front plate having first and second holes aligned, respectively, with said first and second threaded holes, said connecting means including a first screw extending through said first hole and said first threaded hole and a second screw extending through said second hole and said threaded hole, respectively, to allow safe, convenient mounting and adjustable positioning of said first slide support means on said cross member means.

* * * * *